US010399764B2

(12) United States Patent
Jacobs et al.

(10) Patent No.: US 10,399,764 B2
(45) Date of Patent: Sep. 3, 2019

(54) PILL FEEDER

(71) Applicant: PerceptiMed, Inc., Mountain View, CA (US)

(72) Inventors: Alan Jeffrey Jacobs, Palo Alto, CA (US); Brandon Michael Loeb, Campbell, CA (US)

(73) Assignee: PerceptiMed, Inc., Mountain View, CA (US)

( * ) Notice: Subject to any disclaimer, the term of this patent is extended or adjusted under 35 U.S.C. 154(b) by 0 days.

(21) Appl. No.: 15/229,061

(22) Filed: Aug. 4, 2016

(65) Prior Publication Data

US 2018/0037396 A1 Feb. 8, 2018

(51) Int. Cl.
*B65D 83/04* (2006.01)
*A61J 7/02* (2006.01)

(52) U.S. Cl.
CPC ..... *B65D 83/0481* (2013.01); *A61J 7/02* (2013.01); *B65D 2583/049* (2013.01)

(58) Field of Classification Search
CPC .... G07F 17/92; G07F 17/0092; A61J 7/0076; A61J 7/02; B65B 35/06; B65G 47/14
USPC ..... 221/262, 237, 224, 236, 211, 258, 7; 198/803.16
See application file for complete search history.

(56) References Cited

U.S. PATENT DOCUMENTS 8,827,112 B2 * 9/2014 Yuyama ..... A61J 7/02 221/224

FOREIGN PATENT DOCUMENTS

JP 2002-338033 * 11/2002 ..... B65G 47/14
JP 2002-338033 A 11/2002

OTHER PUBLICATIONS

PCT International Search Report and Written Opinion, PCT Application No. PCT/US17/44981, dated Sep. 12, 2017, 11 pages.

* cited by examiner

*Primary Examiner* — Timothy R Waggoner
*Assistant Examiner* — Ayodeji T Ojofeitimi
(74) *Attorney, Agent, or Firm* — Fenwick & West LLP

(57) ABSTRACT

A pill feeder accepts a quantity of pills and organizes the pills into a single file where each pill is output in a controlled orientation at a controlled rate. The pill feeder includes a rotating disk, a rotating rim, a lift gate, a separator gate, and an exit path. The rotating disk receives and moves pills in a rotation direction about a surface of the rotating disk at a first angular velocity. The rotating rim that moves pills received from the rotating disk in the same rotation direction as the rotating disk. The lift gate raises a height above the surface of the rotating rim that permits passage of a single layer of the plurality of pills. A transition to an exit chute of the pill feeder provides a plurality of slopes to control the orientation of pills transitioning from the rim to the exit chute.

20 Claims, 11 Drawing Sheets

PILL FEEDER

BACKGROUND

This invention generally relates to a pill feeding mechanism, and more particularly to orienting a group of pills, and controlling a flow rate, orientation, and interval of the group of pills exiting the pill feeding mechanism.

Pharmacies and chemists often dispense pills to customers or patients on receiving a prescription from the customer or patient. The pharmacist working at the pharmacy will often manually identify, verify and count pills based on the prescription received prior to providing the customer with the pills prescribed. Often, a pharmacist may miscount the number pills to provide to the customer, which results in the customer not receiving the prescribed number of pills. Further, the pharmacist may accidentally provide the customer with different pills than those prescribed to the customer, can be harmful to the customer. To overcome these problems, automated systems and various methods have been developed to count and/or identify pills. However, to function efficiently and accurately, the automated methods often require, as an input, a controlled rate of flow of pills having a controlled orientation. Thus, it is beneficial for accurate and efficient pill identification, verification, and counting that a system be developed to provide the automated systems with a controlled rate of flow of pills having a controlled orientation.

SUMMARY

A pill feeder accepts a quantity of pills and organizes the pills into a single file where each pill is output from the pill feeder in a controlled orientation at a controlled rate and interval. The pill feeder includes a rotating disk, a rotating rim, a lift gate, one or more separator gates, and an exit path. The rotating disk receives and moves pills in a rotation direction about a surface of the rotating disk at a first angular velocity. The rotating rim that transports pills received from the rotating disk in the same rotation direction as the moving surface. In some embodiments, the rotating rim rotates with a second angular velocity, slower than the first angular velocity. Furthermore, the axis of rotation of the rotating rim is different from the axis of rotation of the rotating disk. The lift gate raises a height above the surface of the rotating rim and thereby permits passage of a single layer of the plurality of pills and the one or more separator gates open a width that permits passage of a single row of pills. That is, if two or more pills are stacked on top of each other, the lift gate permits the passage of the first pill located at the bottom of the stack and prevents the passage of the pills stacked on top of the first pill. Pills stacked above the first pill are directed back to the rotating disk. Furthermore, if pills are located side by side as they are being transported by the rotating rim, the separator gate permits the passage of one pill (e.g., the pill closer to the outer edge of the rotating rim) and prevents the passage of the other pill (e.g., the pill closer to the inner edge of the rotating rim). The inner pill is directed back to the rotating disk. The lift gate and the separator gate may further adjust or control the orientation of the pills being transported by the rotating rim. As such, while passing through the lift gate and the separator gate, the plurality of pills are arranged as a single layer and a single row of pills. The single layer and single row of pills can then proceed to the exit path. The exit path includes an exit ramp and guide walls that direct pills from the rim to the exit ramp. The guide walls are contoured to orient pills that are overhanging the interior lip of the rim back to be either complete on the rim or to be directed off the rim and back onto the rotating disk. The contour of the guide walls (i.e. chamfers, slopes, surfaces, ribs, grooves) help prevent pills from being lifted up as they slide along the guide wall and the exit ramp, and to help prevent pills from rolling, tumbling or wedging under another pill and lifting it up. The exit ramp receives pills from the rim as they slide along the guide wall. The contour of the exit ramp is such that pills transition from the horizontal surface of the rim to the downward sloped surface of the exit ramp with a reduced amount of tumbling, flipping, or rolling. After proceeding through the exit path, the pills may pass through one or more sensors that identifies and counts the pills.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1A:
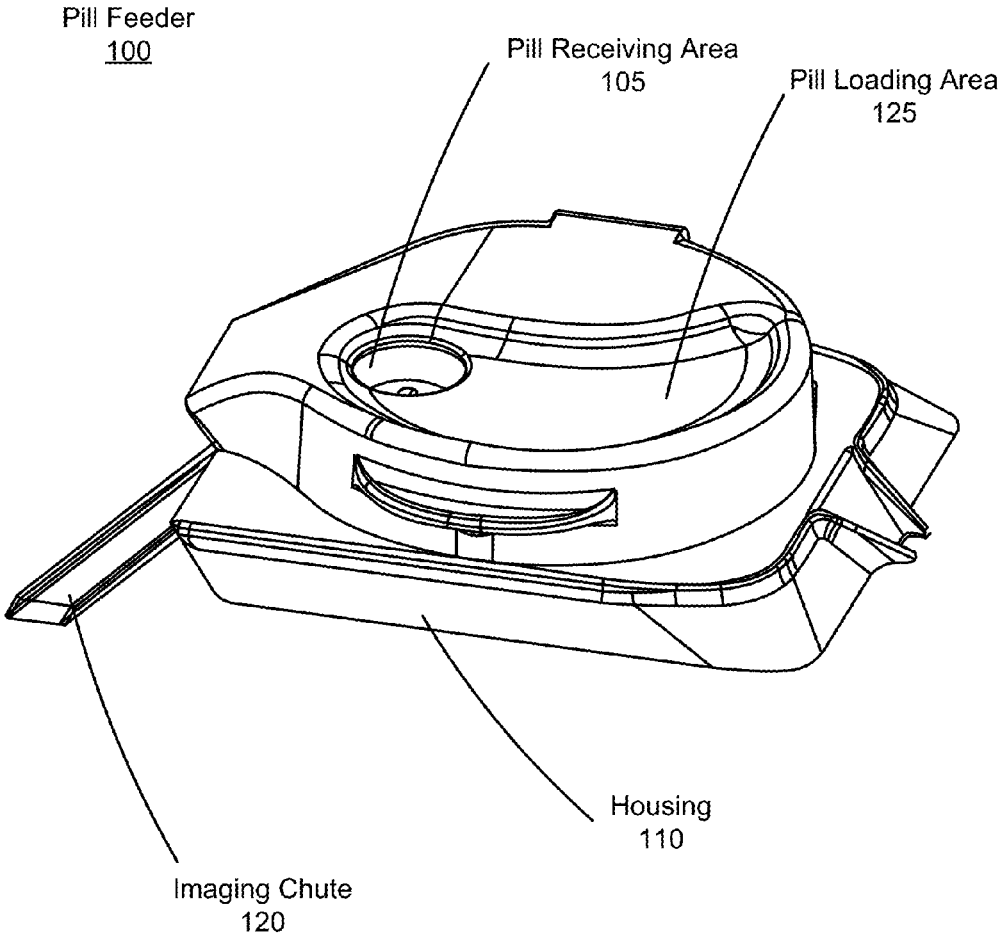
FIGS. 1A and 1B are external views of a pill feeder, according to different embodiments.
Figure 1B:
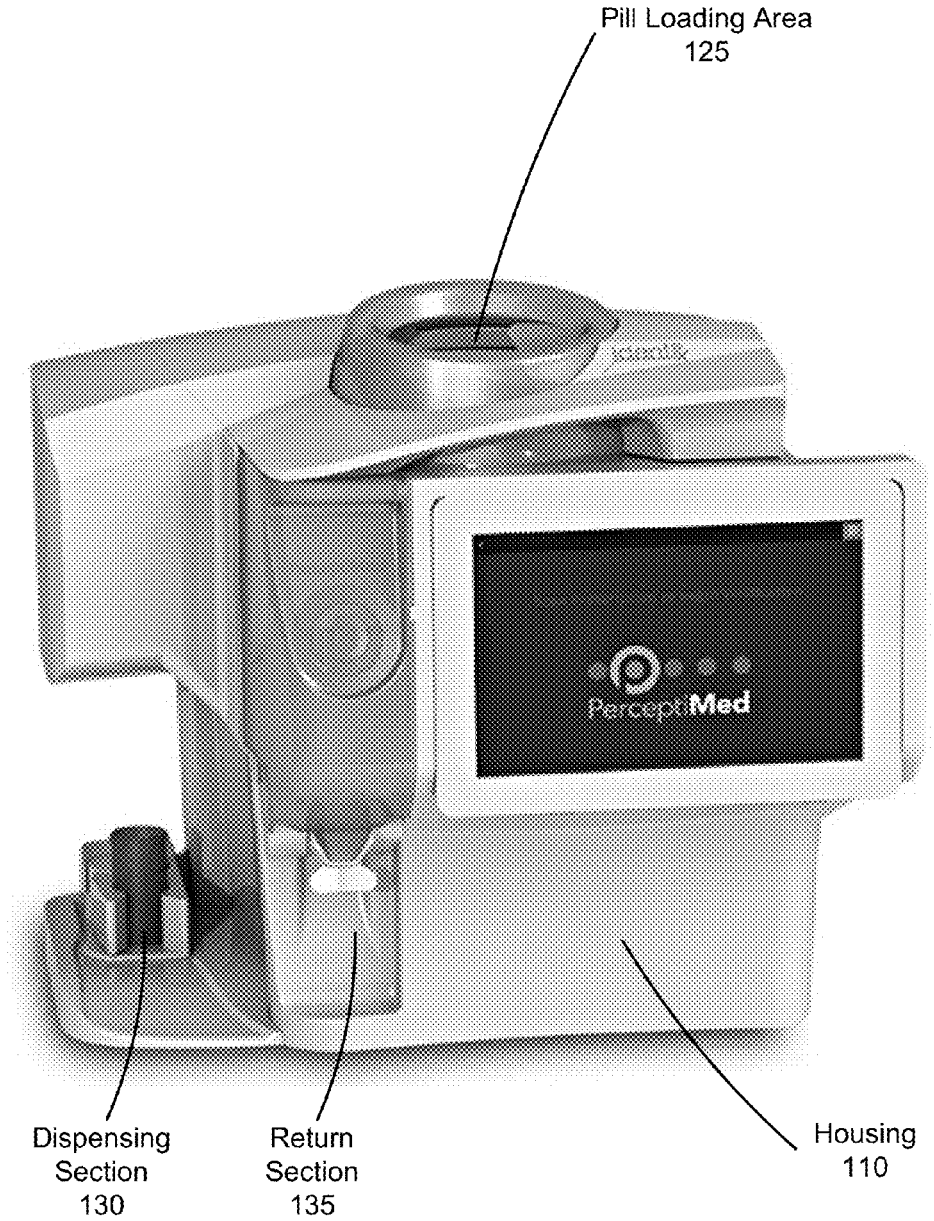

FIG. 1A and FIG. 1B are external views of a pill feeders 100, according to different embodiments. The pill feeder 100 includes a pill loading area 125 for receiving pills from an operator, where the pills may further be moved by the operator from the pill loading area 125 to a pill receiving area 105. In one embodiment, the pill loading area 125 may contain a funnel or other shaped structure to hold or aide in moving the pills into the receiving area 105. The funnel receives a small or large number of pills simultaneously, and holds additional pills while the pill feeder processes pills that have already entered the pill receiving area 105. The pill feeder 100 receives pills in the pill receiving area 105 and uses mechanisms in housing 100 to release pills in a controlled orientation and at a controlled rate down an imaging chute 120. Hence, the pill feeder 100 can be used to supply other mechanisms or objects that may perform functions on or hold pills. For example, the pill feeder 100 may be used with a pill verifying machine to verify pills for a prescription, thereby reducing the time spent by a pharmacist counting or verifying pills. One example of a pill verifying machine is described in U.S. patent application Ser. No. 13/583,598, filed Sep. 7, 2012, which is hereby incorporated by reference in its entirety.

The pill feeder 100 can also be used to separate and orient groups of other types of objects that may be irregularly shaped, such as bolts, nuts, or washers. Similar to receiving pills, the pill receiving area 105 receives a group of irregularly shaped objects. The mechanisms in the housing 110 act on the irregularly shaped objects releasing the objects, one by one, in a controlled orientation and at a controlled rate.

The pill receiving area 105 receives pills from the pill loading area 125 and transfers the pills to the pill control mechanisms within the housing 110. The user primarily interacts with the pill feeder 100 through the pill receiving area 105. The pill feeder 100 may be used with pills of varying sizes, shapes, and textures, and may include capsules, tablets and other medication types, though generally similar pills are used with the pill feeder 100 at a single time. For example, a pill may be oblong in shape, purple in color and have a gelatinous coating or circular in shape, or a pill may be white in color and have a chalky texture. As examples, the pill feeder 100 may be used with a hundred large round pills or thirty small oblong pills to feed pills individually through the imaging chute 120. The user places pills in the pill receiving area 105 from the pill loading area 125 individually or in groups.

Components of the disk housing 110 move pills from the pill receiving area 105 to the imaging chute 120. In one embodiment, the housing 110 houses multiple moving surface, such as a disk and a rim, and one or more motors to rotate the disk and the rim that is used to move the pills throughout the housing. The disk, the rim, and other components located inside the disk housing 110 are further illustrated in FIGS. 2A and 2B. A disk or a generally circular-shaped surface is one example of a moving surface that can be used in the pill feeder. Other shapes are also possible for both the moving surface and the housing. In some embodiments, the moving surface has a conveyor belt design. The housing 110 also includes components that control the orientation of the pills and separate pills from one another. A sensor may control the speed of the disk rotation such that pills exiting the imaging chute 120 leave the pill feeder 100 at a controlled speed. Thus, pills placed in the pill receiving area 105 fall on the rotating disk and the rotating disk moves the pills to the rotating rim, and the rotating rim moves the pills to the imaging chute 120. While the pills are transported by the rotating rim, the orientation of the pills may be changed so that the pills have a uniform orientation as they travel down the imaging chute 120. The imaging chute 120 includes an entry area on one end for receiving a pill from the pill feeder 100 and at least one exit area at another end for providing the pill to a mechanism or object attached to the pill feeder 100. In addition to a controlled rate of exit, the entry area of imaging chute 120 typically receives the pills at a controlled orientation, such as on a flat side of the pill.

As shown in FIG. 1B, the pill feeder 100 may be a portion of a pill verification system that additionally includes a dispensing section 130 where pills are dispensed to be provided to a patient, and a return section 135 where pills are returned back to a stock bottle for storage. In this example, the pill feeder shown in FIG. 1B may include an imaging chute (not shown) from the pill feeder portion of the pill verification system to a pill imaging and verification apparatus that dispenses verified pills to the dispensing section 130. For instance, pills that were verified to match the prescription of a patient may be dispensed through the dispensing section 130, and pills that did not match the patient's prescription, or pills in excess of the prescribed amount are returned to a bottle through the return section 135.

Figure 2A:
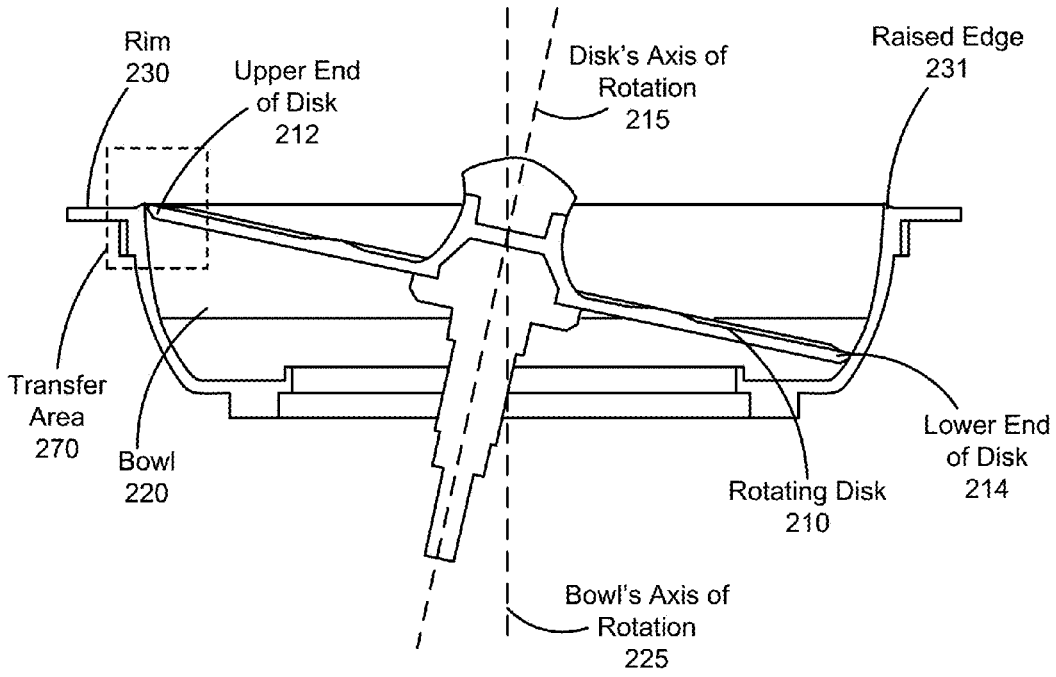
FIG. 2A is a cross sectional view of components inside the housing of the pill feeder, according to one embodiment.
Figure 2B:
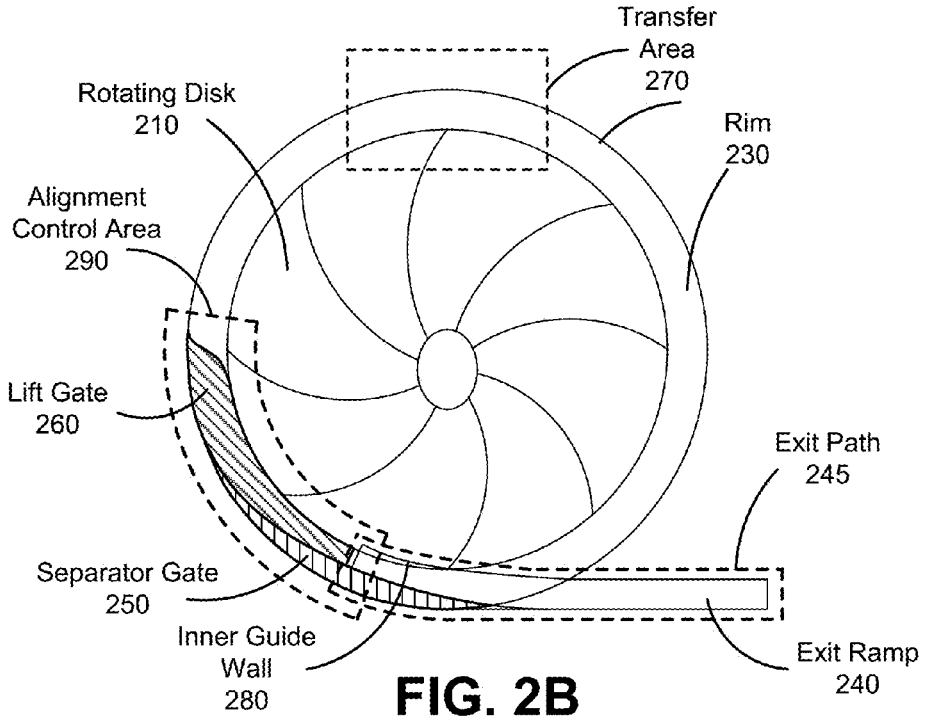
FIG. 2B is a top view of the components inside the housing of the pill feeder, according to one embodiment.

FIG. 2A is a cross sectional view of components inside the housing 110 of pill feeder 100, according to one embodiment. FIG. 2B is a top view of the components inside the housing 100 of pill feeder 100, according to one embodiment. The pill feeder 100 includes a rotating disk 210 and a bowl 220 having a rim 230. The pills first make contact with a rotating disk 210 when they are placed in the receiving area 105. As the pills make contact with the rotating disk 210 they may rest in groups bunched together or spread out individually across the surface of the rotating disk 210, based on the number of pills that are placed in the receiving area 105. Furthermore, each pill's orientation may differ from that of the other pills in the group. For example, a circular or cylindrical pill may enter the receiving area 105 and rest on the rotating disk 210 on its side, permitting the pill to roll on the rotating disk 210. For the pills to exit the pill feeder 100 in a controlled orientation and at a controlled rate, the pills are oriented to lay flat on the rotating disk 210 and separated from one another (e.g., not stacked on top of one another or bunched together such that a portion of a pill is resting on another pill) by the pill feeder 100.

The rotating disk 210 is a circular platter rotating about a center spindle, and in this embodiment, generally moves the pills counterclockwise within the housing 110. The rotating disk 210 is made of a material that provides sufficient friction to the pills to move the pills as the disk rotates. For example, the rotating disk 210 may be made of textured plastic with de-bossed patterns. As pills are manufactured with a variety of textures, some of which may be very smooth, the friction on the surface of the disk is sufficient to move these smooth pills. The surface of the rotating disk 210 is also ridged, scored, hatched, or otherwise textured in various embodiments to provide additional friction and to dislodge pills that may get jammed or stuck.

In one embodiment, as shown in FIG. 2B, the rotating disk 210 has ridges either rising from the surface of the rotating disk 210 or embedded in the surface of the rotating disk 210. The ridges are angled in any suitable direction, such as diagonally across the surface of the rotating disk 210 or radially outward from the center of the rotating disk 210. The ridges may assist in the orientation of pills and disrupt pills that are rolling on the rotating disk 210. In other embodiments, depressions or other structures present on the rotating disk 210 are used to assist in the orientation of the pills.

In some embodiments, as pills are added to the pill feeder 100, the pill move towards the lower end 214 of the rotating disk 210 due to the effect of gravity on the pills. In other embodiments, the pill may randomly land throughout the surface of the rotating disk 210. As the rotating disk 210 rotates, the pills located on the rotating disk are displaced towards the outer edge of the rotating disk 210 due to a centrifugal force exerted to the pills. In some embodiments, the angular velocity of the rotating disk 210 is controlled based on an amount of centrifugal forced to be exerted to the pills. If the rotating disk 210 is rotated with excessive angular velocity, the large centrifugal force exerted to the pills will cause the pills to bunch in multiple layers around the outer edge of the rotating disk 210. If the rotating disk 210 is rotated with insufficient angular velocity, the centrifugal force exerted to the pills may not be enough to overcome the force due to friction between the pill and to rotating disk 210, and thus, the pills may not be displaced towards the outer edge of the rotating disk 210. Otherwise, the centrifugal force exerted to the pills displaces the pills towards the outer edge of the rotating disk 210 and substantially arranges the pills in a single layer.

The bowl 220 is a round open-top container and may rotate in the same direction as the rotating disk 210. In one embodiment, the bowl 220 has a concave or hemispherical shape. In some embodiments, the bowl 220 has a rim 230 located on an upper edge of the bowl 220. As such, bowl 220 and the rim 230 rotate with the same angular velocity. In other embodiments, the rim 230 is located near the upper edge of the bowl 220, but is not attached to the bowl 220. In this embodiment, the rim 220 rotates independently of the bowl 220. In one embodiment, the rim 230 rotates in the same direction as the rotating disk 210 while the bowl 220 stays stationery. In some embodiments, the bowl 220 rotates with a slower angular velocity compared to the rotating disk 210. In some embodiments, the angular velocity of the bowl 220 and the rotating disk 210 are controlled based on characteristics of the pills loaded in the pill feeder 100.

The rotating disk 210 rotates inside the bowl 220. Furthermore, the rotating disk 210 rotates slanted at an angle with respect rotation of the bowl 220. That is, the axis of rotation 215 of the rotating disk 210 forms an acute angle with the axis of rotation 225 of the bowl 220. The upper end 212 the rotating disk 210 is flush with the rim 230 of the bowl 220 and the lower end 214 of the rotating disk 210 is in contact with an inner surface of the bowl 220.

As the rotating disk 210 rotates, pills are rotated from the lower portion of the bowl 220 to the rim 230 and transition from the rotating disk 210 to the rim 230. As the pills lie on the rotating disk 210, the pills may fall to the outer edge of the rotating disk 210 in the bowl 220. As the rotating disk 210 rotates, the pills may stay at the edge of the disk due to centrifugal force and friction between the rotating disk 210 and the pills. Pills located near the lower end 214 of the rotating disk 210 are stopped by the inner surface of the bowl 220, while the pills located within the transfer area 270 near or on the upper end 212 of the rotating disk 210 may transition to the rim 230. That is, the centrifugal force being exerted to pill located within the transfer area 270 is not counteracted by bowl 220 and thus, the pills located within the transfer area 270 may move radially outwards and on to the rim 230. The pills that transition to the rim 230 are transported by rim 230 through the alignment control area 290, where lift gate 260 and the separator gate 250 are located, and to the exit path 245. As described further below, the alignment control area 290 may effectively limit the height and width of the pills on the rim 230, and return pills that exceed either the height or the width. The alignment control area 290 may also limit both the height and width together to return pills to the rotating disk that rotate or turn in meeting limitation separately. In some embodiments, the exit path 245 includes an inner guide wall 280, an outer guide wall 255, an exit ramp 240, and may also lead to an imaging chute 120 as shown in FIG. 1A, or towards a pill verification as in FIG. 1B.

The rim 230 includes a flat surface and a raised inner edge 231. The flat surface of the rim 230 transports pills from the transfer area 270, through the lift gate 260 and the separator gate 250 to the exit path 245. The raised inner edge prevents pills from falling off the rim 230 unless limited by the lift gate 260 and separator gate 250. The raised inner edge in conjunction with the separator gate 150, may help rotate pills that are incorrectly oriented.

Figure 3A:
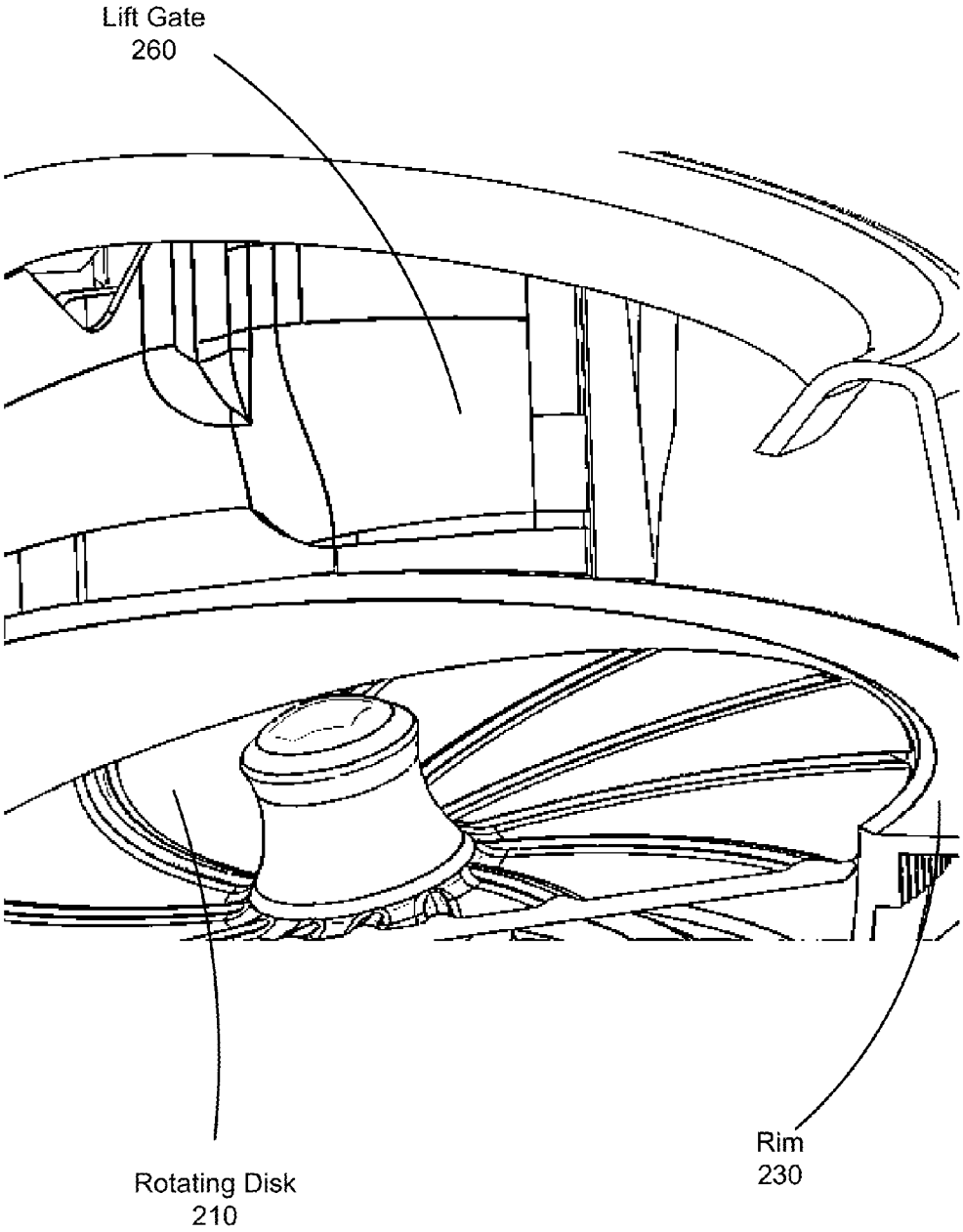
FIG. 3A shows a lift gate that opens vertically, according to one embodiment.

As the pills are moved on the rim 230, the pills come in contact with the lift gate 260. FIG. 3A shows a lift gate that opens vertically, according to one embodiment. The lift gate 260 is located on the rim 230 in the rotation direction of the rotating disk 205 relative to the transfer area 270 (e.g., downstream from the transfer area 270 in the direction of the movement of the rim 230). In one embodiment, the lift gate 260 is attached to a post or a lift post. In another embodiment the lift gate 260 pivots open along an axis horizontal and above the rim 230. The post is raised or lowered vertically, or pivoted, by a lift gate motor, thereby raising, lowering, or rotating the lift gate 260. The lift gate 260 prevents the pills from stacking on top of each other as they pass through the lift gate 260 by providing vertical clearance only for the height of a single pill or for a height slightly greater than that of a single pill. The lift gate 260 also ensures that the pills that pass through the gate 260 rest on the same dimension or edge of the pill. Thus, the lift gate 260 organizes the pills by allowing only pills that are oriented in a particular way (e.g., on a side) to pass the lift gate 260. For example, both stacked and rolling pills may be prevented from passing the lift gate 260 by the position of the lift gate 260. The lift gate 260 is at least partially curved inward towards the center of the rotating disk 210 and bowl 220, such that pills that do not pass under the lift gate are diverted inward and returned to the bowl 220. Those pills that are returned to the bowl 220 are rotated upwards again by the rotating disk 210 to transition to rim 230. In some embodiments, the bottom portion of the lift gate is curved inward.

In one embodiment, the pill feeder receives settings for positioning the lift gate 260 and separator gate 250 according to the type of pill. In other examples, the positions for the lift and separator gates may be automatically determined. In one embodiment, the lift gate 260, in a closed position, initially rests close to the rim 230. After the pill feeder initiates operation, the lift gate 260 is gradually raised. The lift gate 260 is raised to a height that allows for at least one pill, in an orientation, to pass through the gate 210. As the gate 260 rises, the pill profile that is lowest among the pill orientations passes under the lift gate 260.

In some embodiments, the lift gate 260 begins at or near the outer circumference of the rim 230 and gradually slopes towards the inner circumference of the rim 230 in the direction of the rotation of the rim. The shape of the lift gate 260 may push pills that are too big to pass through the vertical clearance provided by the lift gate 260, or may help rotate pills that are laying on their side. In other embodiments, the lift gate 260 has other shapes that help reduce the likelihood of a jam at the beginning of the lift gate 260.

Figure 3B:
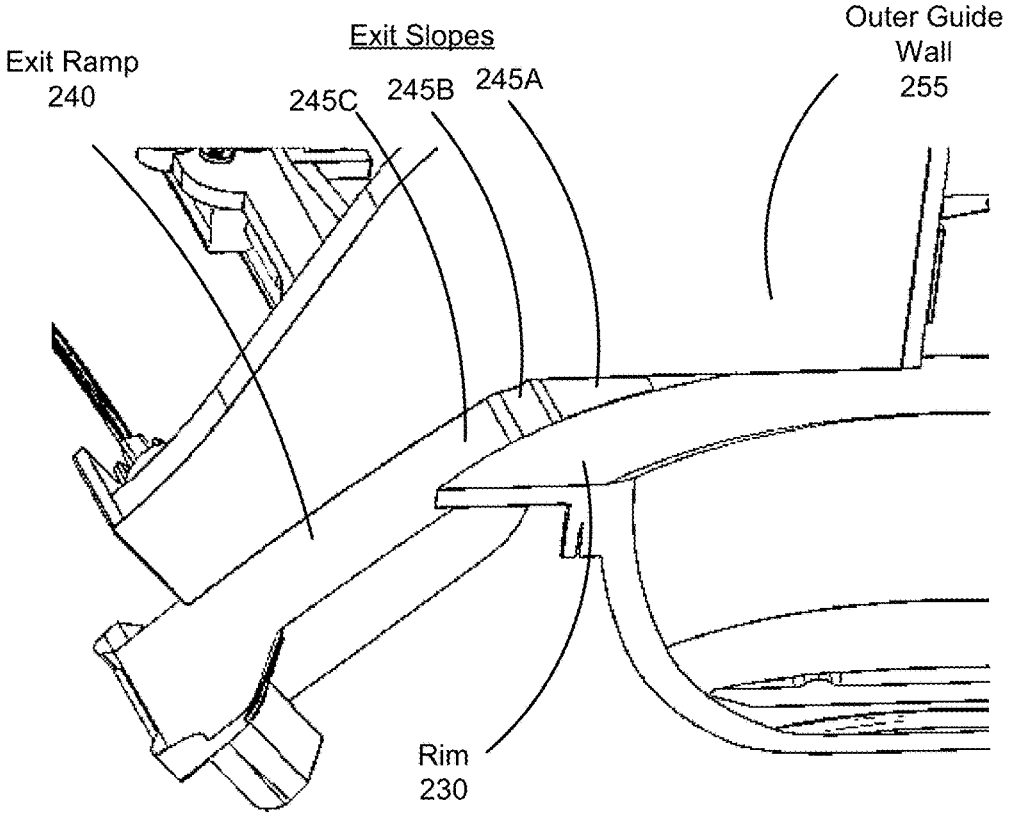
FIG. 3B shows an exit ramp with exit slopes and an outer guide wall extending along down the exit ramp according to one embodiment.
Figure 3C:
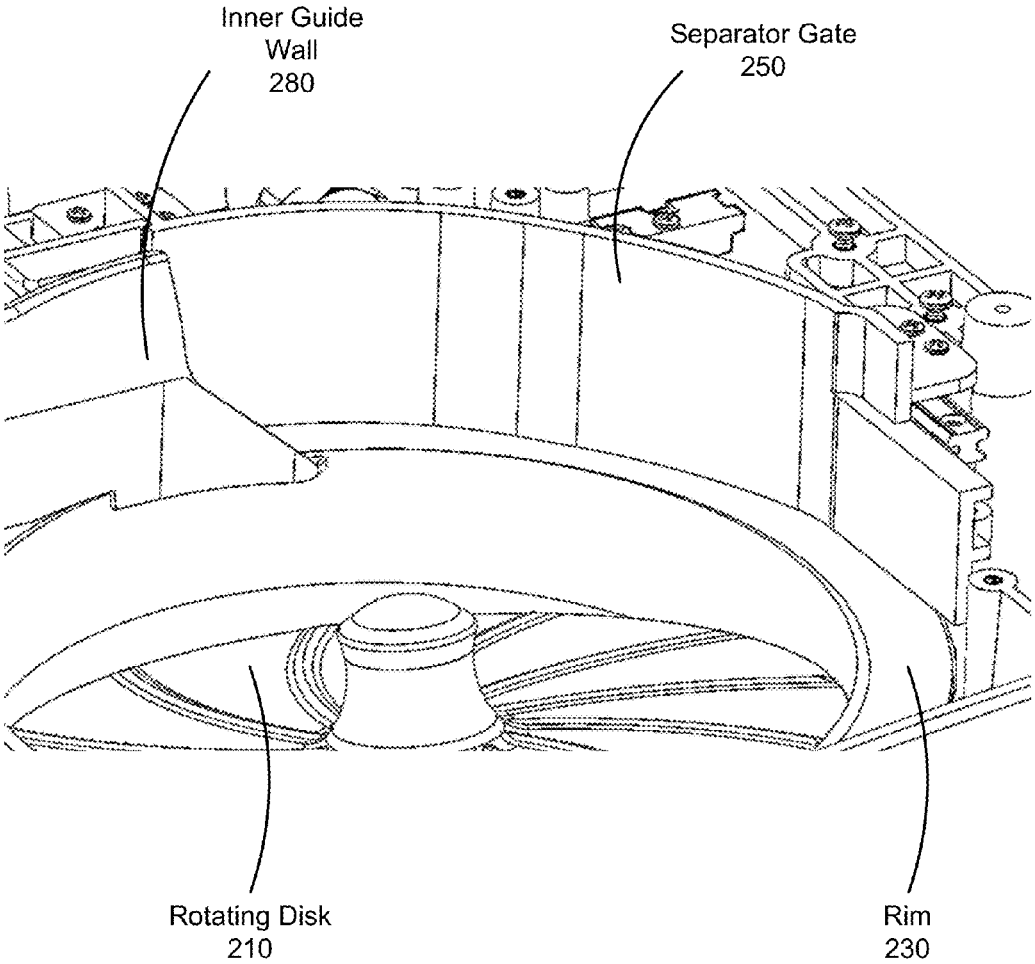
FIG. 3C shows a separator gate and inner guide wall, according to another embodiment.

The separator gate 250 separates the pills prior to the pills entering the exit path 245. FIGS. 3B and 3C show a separator gate and the rim of the bowl, according to different embodiments. The separator gate is located on the rim 230 in the rotation direction of the rim 230 relative to the transfer area 270 (e.g., it is downstream from the transfer area 270 in the direction of movement of the rim). The separator gate 250 opens from a closed position and ensures that pills enter the exit path 245 in a single file and in a controlled orientation. The separator gate 250 is opened far enough that a single pill may remain on the rim past the portion of the rim including the separator gate 250. The separator gate 250 also ensures that the pills that pass the separator gate 250 are generally oriented in a similar direction. Thus, the separator gate 250 organizes the pills into a single file with each pill being similarly oriented, by allowing only a single pill to remain on the rim past the separator gate 250 and pushing pills that are not oriented on the rim back into the bowl 220 (i.e., on the rotating disk 210)

The separator gate 250 operates by reducing the width of a portion of the rim 230. When the separator gate 250 is fully closed, the separator gate 250 fully blocks the portion of the rim 230 where the separator gate 250 is located. As such, the separator gate 250 blocks the movement of pills being transported by the rim 230 and pushes the pills off the rim 230 on to the rotating disk 210. When the separator gate 250 is opened to allow the passage of a single file of pills, the separator gate 250 reduces the width of the portion of the rim where the separator gate 250 is located to be substantially equal to the width of the pills. As such, if two pills positioned side by side approach the separator gate 250, the pill that is closer to the inner edge of the rim 230 is pushed off the rim 250 on to the rotating disk 210. Furthermore, if pill approaches the separator gate 250 oriented incorrectly, the separator gate 250 may rotate the pill or may push the pill off the rim 230 on to the rotating disk 210.

Figure 3D:
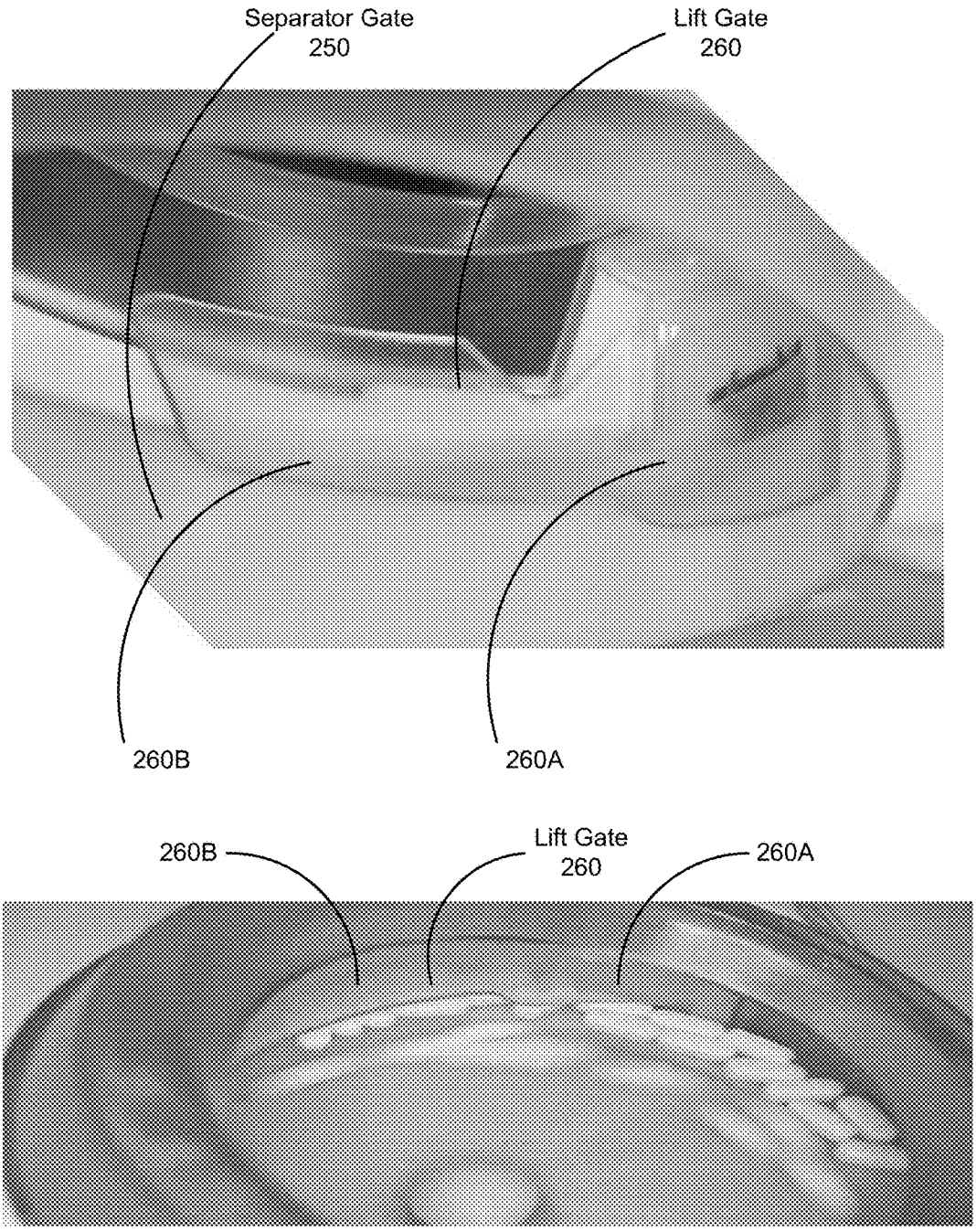
FIG. 3D shows a lift gate having multiple sections, according to one embodiment.

In some embodiments, as shown in FIG. 3D, at least a portion 260A of the lift gate 260 is positioned before the separator gate 250 in the rotating direction of the rim 230. In these embodiments, the lift gate 260 may further include a portion 260B that extends through the separator gate 250. Having an extended lift gate 260 prevents pills from transferring from the rotating disk 210 onto the rim 230 in the alignment control area 290. For instance, if an excessive amount of pills is placed in the pill feeder 100, the pills may pile up on the rotating disk 210, and thus, the pills may be able to transfer from the rotating disk 210 to the rim 230 in locations other than the transfer area 270. As such, having the lift gate 260 extending through the separator gate 260 provides simultaneous control on the vertical clearance of the pills and the horizontal clearance of the pills right before the exit path 245 (e.g., as shown in FIGS. 5D and 5E).

The exit path includes a downward sloping exit ramp 240, one or more guide walls, and imaging chute 120. In one embodiment the exit path includes one or more of guide walls attached to the housing 110. In one embodiment the inner guide wall 280 and outer guide wall 255 are positioned to substantially orient the exit path 245, such that the pills gradually move across the rim 230 to the imaging chute 120 at an angle. FIG. 3B shows the exit ramp 240 with and the outer guide wall 255, according to one embodiment. FIG. 3C shows an inner guide wall 280, according to one embodiment. The angle of the exit path 240 as it moves across the rotating disk 210 enables the pill to move from the separator gate 250 to the exit ramp 240 despite the centripetal force experienced by the pill. The shape and positioning of the inner and outer guide walls, ensures that a pill leaving the separator gate 250 can exit the pill feeder 100 at a controlled rate and interval, while maintaining a controlled orientation.

In some embodiments, the inner guide wall 280 extends beyond the inner edge of the rim 230, covering a portion of the rim 230 directly above the rotating disk 210. That is, the exit guide 280 may allow the passage of pills that have a portion extending beyond the inner edge of the rim 230 after those pills have passed the separator gate 250. For instance, pills that oriented at a slight angle compared to a tangential direction of the rim 230 may be guided by the inner guide wall 280 to the exit chute 240 instead of being pushed off the rim 230 onto the rotating disk 210 or causing a jam at the entrance of the exit path 245.

In one embodiment, the inner guide wall 280 extends to or overhangs the inner edge of the rim 230, follows the slope of the exit ramp 240 and extends completely or partially down the length of the exit ramp. The inner guide wall 280 is contoured to orient pills that are overhanging the interior lip of the rim 320 to be either completely on the rim 230 or to be directed off the rim 230 and back to the rotating disk 210. In one embodiment the portion of the inner guide wall 280 that overhangs the inner side of the rim 230 has sloped leading edge and a flat surface parallel to the plane of the rim 230. In one embodiment the inner guide wall 280 has ribs or grooves that help preventing pills from lifting up as they slide along the guide wall, and to prevent pill from rolling, tumbling, or wedging under another pill as they slide along the inner edge of the guide wall.

In one embodiment, the outer guide wall 255 follows the surface contour of the exit ramp 240 and extends completely or partially down the length of the exit ramp. In one embodiment the inner guide wall 255 is movable to change the width of the exit path 245. In another embodiment the outer guide wall 255 is connected to the separator gate 250.

Figure 3E:
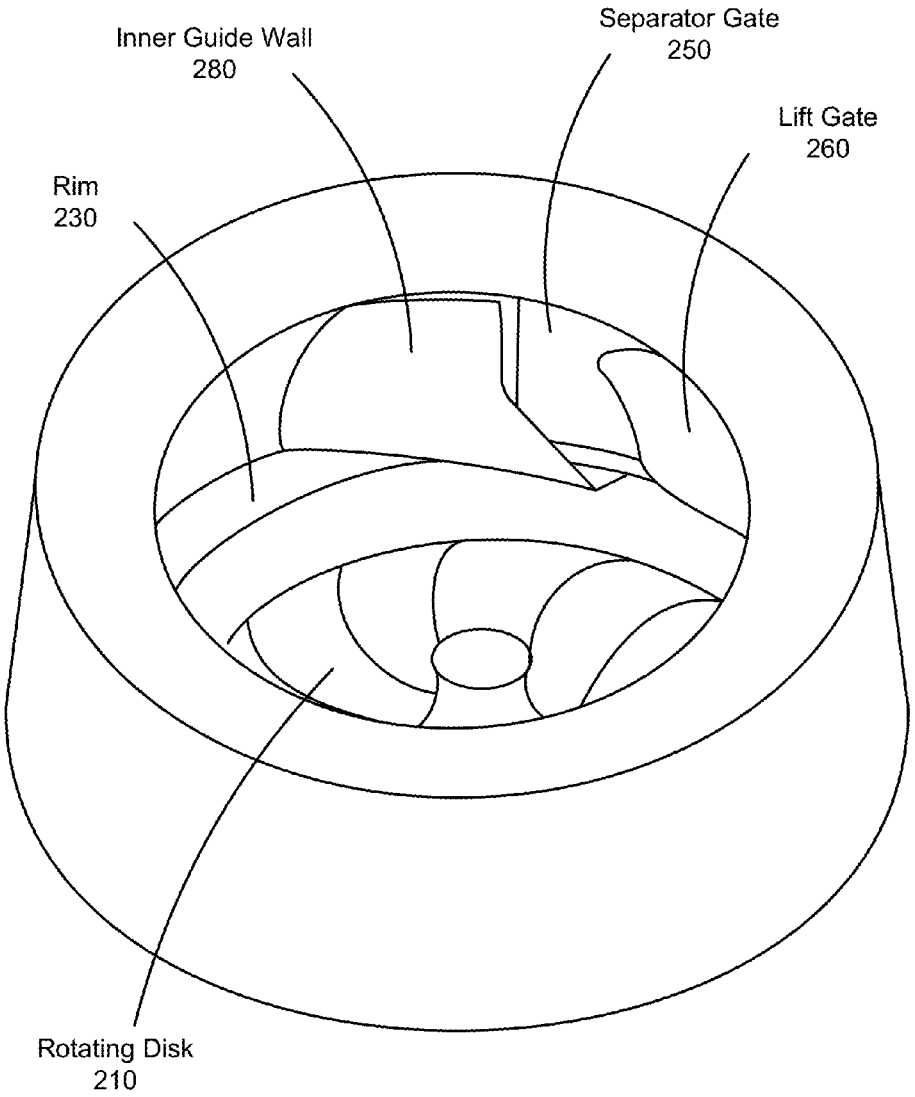
FIG. 3E shows an inner guide wall, a separator gate and a lift gate, according to one embodiment.

In some embodiments, the inner and outer guide walls 280 and 255 overlap with one or both of the separator gate 250 and the lift gate 260. FIG. 3E shows an exit guide overlapping with a separator guide and a lift guide, according to one embodiment. That is, in at least one angular position of the rim 230, both the exit guide 280, the separator gate 250, and the lift gate 260 can act on a pill by constraining the vertical clearance of the pill (by the lift gate 260), constraining the horizontal clearance of the pill (by the separator gate 250), and guiding the pill through the exit path 245 (by the inner guide wall 280).

The exit ramp 240 receives pills from the rim as they are directed along the rim by the inner and outer guide walls. The contour of the exit ramp is such that pills transition from the horizontal surface of the rim to the downward sloped surface of the exit ramp without tumbling, flipping or rolling.

Returning to FIG. 3B, the exit chute 240 may provide a set of exit slopes 245 as a pill fully transitions to the exit chute 240. In some embodiments, the slope of the exit ramp 240 gradually increases from an initial slope 245A to a final slope 245C through one or more intermediate slopes 245B in the portion of the exit chute 240 in which the pills transition from the rim 240 to the exit chute 240. In some embodiments, the initial slope 245A is flat (i.e., flush) with the rim 230. As the pills transition onto the exit chute 240, the pills experience the initial slope and then the intermediate slope(s) 245B before the final slope 245C. As the slope gradually increases, the pill can smoothly transition from the flat rim 230 to the exit chute 240. Because the slope is initially flat and increases over the intermediate slopes 245B, the pill does not experience a sudden change in slope and is less likely to rotate, spin or change orientation when transitioning to the exit chute 240. This transition section of the exit chute 240 increases stability of the pills and consistency of the pill orientation when entering the exit chute 240 and when entering any subsequent system after the pill feeder, such as a pill imaging or verification system.

In some embodiments, a plurality of exit path sensors (not shown) monitors the rate at which pills flow past the separator gate, guide walls and exit ramp. In one embodiment, the exit path sensor is a light-based detector that is occluded when a pill passes between an emitter and detector pair. In another embodiment the sensor emits and detects light reflected by a pill as it passes by the sensor. The sensor determines the time distance between the leading edge and the trailing edge of each pill as they pass through the exit path 240, by recording the amount of time the sensor is occluded. Based on the time distance the sensor determines the rate at which each pill enters and exits the exit path 240. This rate represents the rate at which pills leave the pill feeder 100. In one embodiment the sensor regulates the speed of rotation of the rotating disk 210 and the speed of rotation of the bowl 220 based on the rate of pills exiting the pill feeder 100, as determined by the sensor. The speed of the rotating disk 210 and the speed of rotation of the bowl 220 can be controlled to reduce the rate of pills exiting the pill feeder 100 below a maximum.

In some embodiments, a controller (not shown) receives sensor inputs from the various sensors and controls operation of the rotating disk 210, bowl 220, lift gate 260, separator gate 250, and additional mechanical components as described throughout. The controller in varying embodiments is implemented as a processer executing instructions on a memory, a hardware circuit, or a combination thereof. Thus, the controller operates the lift gate motor to raise the lift gate 260, controls rotation of the rotating disk 210, and so forth. The controller may receive indications from the different sensors of the pill feeder 100 to identify and monitor the location of pills within the pill feeder and use the sensor indications as described herein.

In certain embodiments, the controller may also receive an identification of a pill type for the pills to be input to the pill receiving area 105. The controller in one embodiment accesses a look-up table or database to retrieve settings to operate the pill feeder based on the pill type. The settings may include a height at which to set the lift gate or a width to set the separator gate. These lift gate and separator gate settings are used to set the height of the lift and separator gate in an embodiment. In addition, the settings may specify a rate at which to turn the rotating disk 210 and the bowl 220. The settings may also indicate behaviors to clear jams for the particular pill type, such as parameters and/or patterns for changing the rotation of the rotating disk 210 or the bowl 220.

Figure 4A:
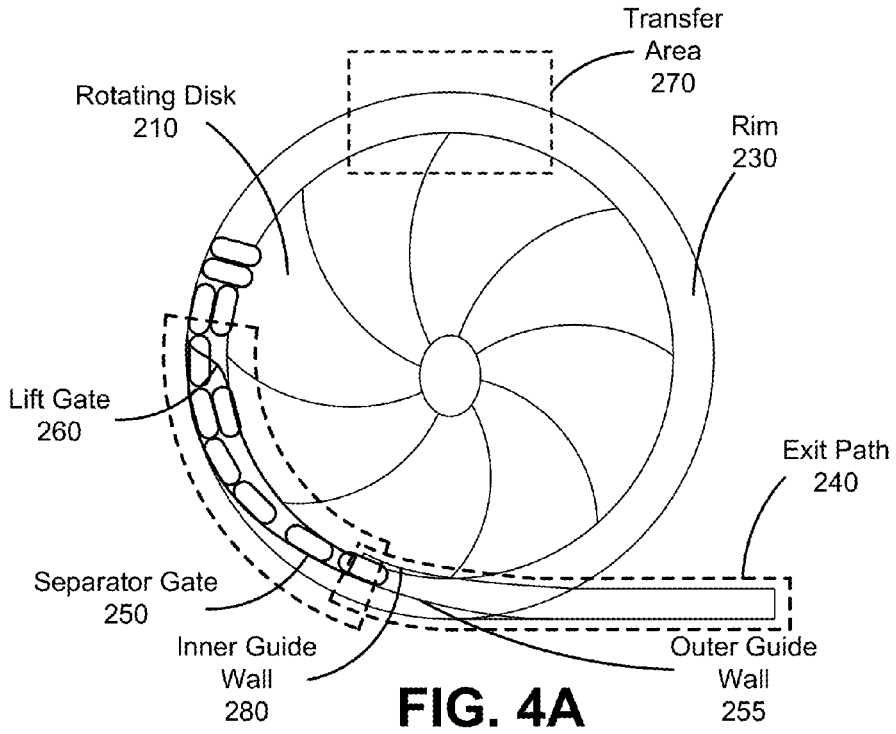
FIG. 4A is a top view of pills being transported by the rim of the rotating bowl, according to one embodiment.
Figure 4B:
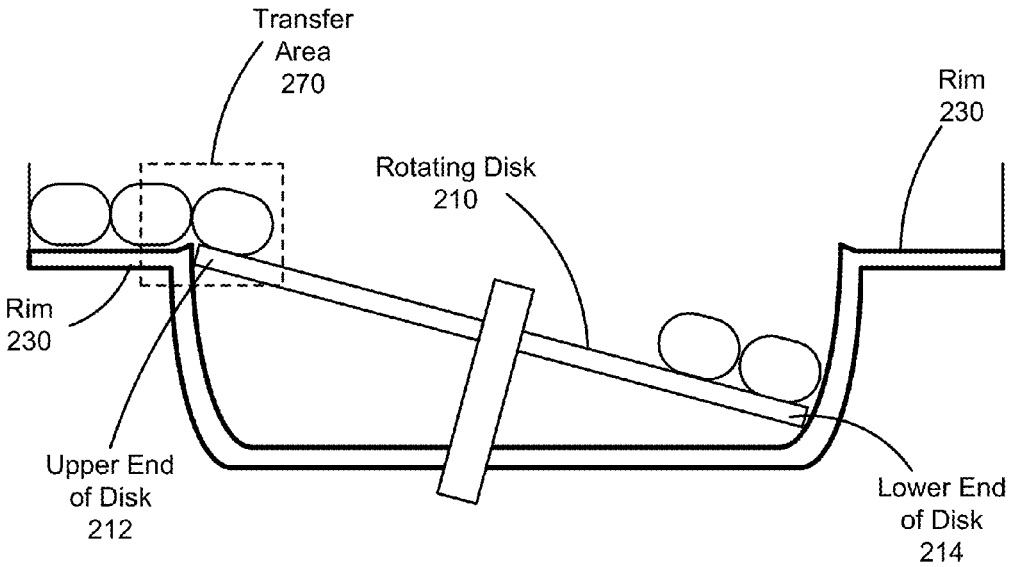
FIG. 4B is a cross sectional view of pills being transported to the rim of the rotating bowl, according to one embodiment.

FIG. 4A is a top view of pills being transported to the rim of the bowl and FIG. 4B is a cross sectional view of pills being transported to the rim 230 of the bowl 220, according to one embodiment. Pills placed on the rotating disk 210 may move towards the lower end 214 of the rotating disk 210 due to the effect of gravity. Alternatively, pills may randomly land and rest on the surface of the rotating disk 210. As the rotating disk 210 rotates around the disk's axis of rotations 210, the pills are pushed radially to the edges of the rotating disk 210. Pills that are within the transfer area 270, near the edge of the rotating rim 210 that is flush with the rim 230 are further pushed on to the rim 230. As pills are transported by the rotating rim 230, the pills pass through the lift gate 260 and the separator gate 250.

Figure 5A:
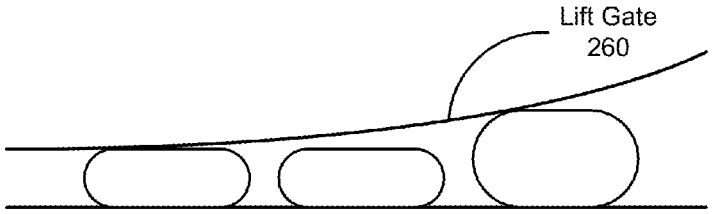
FIG. 5A shows pills passing through lift gate 260, according to one embodiment.

FIG. 5A shows pills passing through lift gate 260, according to one embodiment. The lift gate 260 is configured to allow the passage of pills lying flat on the rotating rim 230 and to block or rotate pills lying on their sides. That is, the lift gate 260 allows the passage of pills oriented so that the height of the pill is its shortest, and blocks the passage of pills having other orientations. Pills that are oriented incorrectly may be rotated by the lift gate 260 so that the pill can pass through the lift gate 260. In other embodiments, the lift gate 260 may instead push pills oriented incorrectly off the rotating rim 230 and on to the rotating disk 210.

Figure 5B:
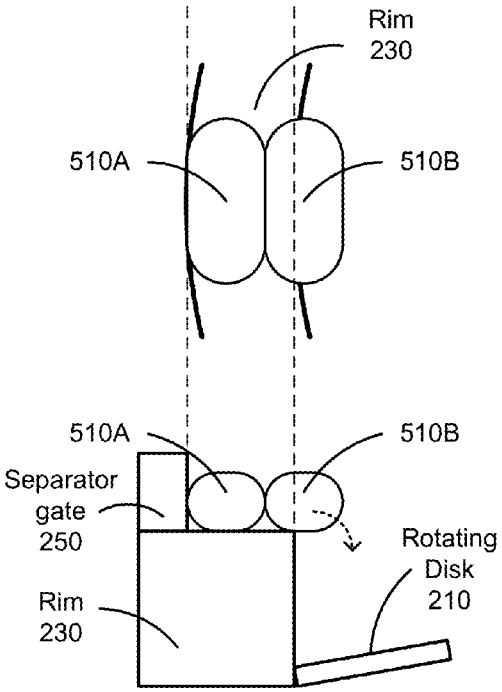
FIG. 5B shows two pills positioned side by side passing through a separator gate, according to one embodiment.

FIG. 5B shows two pills positioned side by side passing through separator gate 250, according to one embodiment. Pills passing through the separator gate 250 are pushed towards the inner edge of the rotating rim 230. FIG. 5 shows an outer pill 510A and an inner pill 510B. As pills 510A and 510B are pushed towards the inner edge of the rotating rim 230 by the separator gate 250, the center of mass of the inner pill 510B moves out of the rim 230. Once the center of mass of the inner pill 510B moves out of the rim 230, the inner pill falls off from them rim 230 on to the rotating disk 210, leaving only the outer pill 510A on rotating rim 230.

Figure 5C:
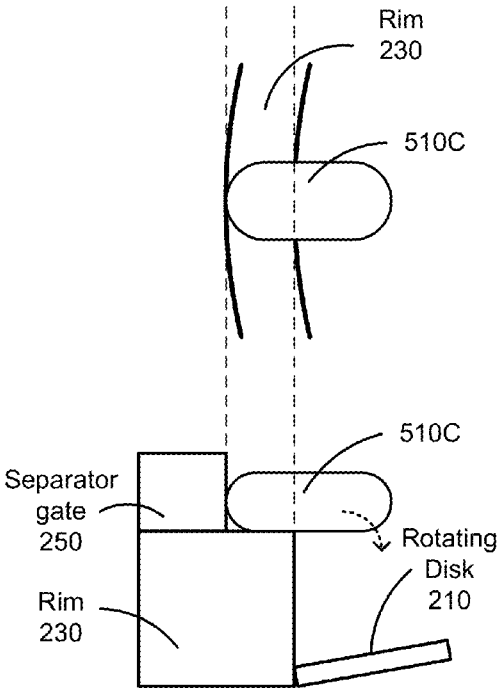
FIG. 5C shows a pill oriented incorrectly passing through a separator gate, according to one embodiment.
Figure 5D:
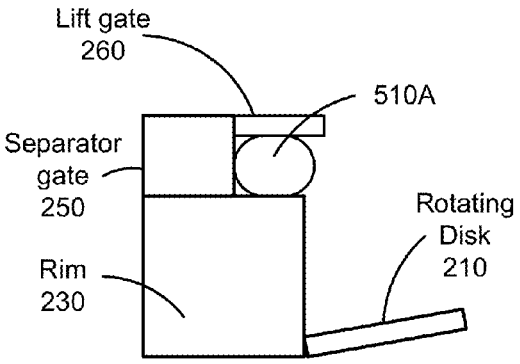
FIG. 5D shows a pill passing through separator gate and a lift gate that extends to a segment where the separator gate is located, according to one embodiment.
Figure 5E:
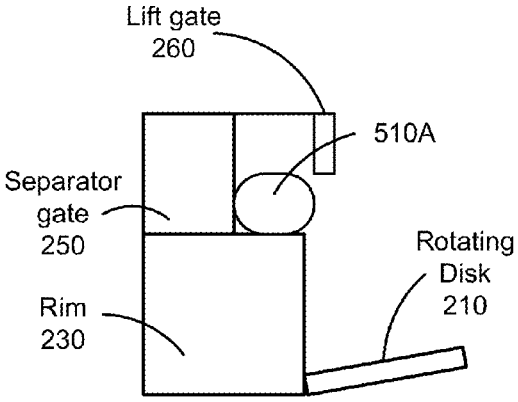
FIG. 5E shows a pill passing through a separator gate and a lift gate that has a portion that extends to a segment where the separator gate is located, but does not control the vertical clearance of the pills being transported by the rim, according to one embodiment.

FIG. 5C shows a pill 510C oriented incorrectly passing through separator gate 250, according to one embodiment. As pill 510C is pushed towards the inner edge of the rotating rim 230 by the separator gate 250, the center of mass of the pill 510C moves out of the rim 230. Once the center of mass of the pill 510C moves out of the rim 230, the pill 510C falls off from the rim 230 on to the rotating disk 210.

FIG. 5D shows a pill passing through separator gate 250 and a lift gate 260 that extends to a segment where the separator gate 250 is located, according to one embodiment. In this embodiment, both the vertical clearance and the horizontal clearance are concurrently controlled. FIG. 5E shows a pill passing through a separator gate 250 and a lift gate 260 that has a portion that extends to a segment where the separator gate 250 is located, but does not control the vertical clearance of the pills being transported by the rim 230, according to one embodiment. In this embodiment, the lift gate 260 prevents pills from transferring from the rotating disk 210 to the rim 230 in the alignment control area 290, while providing a greater amount of freedom to the movement of the pills passing through the alignment control area 290.

In some embodiments, the lift gate 260 and the separator gate 250 are shaped to provided multiple regions where at least one of the vertical clearance and horizontal clearance is being controlled. For instance, the lift gate 260 may include a first portion that that controls the vertical clearance without having the separator gate controlling the horizontal clearance. The lift gate 260 may further include a second portion that does not control the vertical clearance but allows the separator gate 250 to control the horizontal clearance. Additionally, the lift gate 260 include a third portion that controls the vertical clearance while the separator gate controls the horizontal clearance (e.g., as shown in FIG. 5E). That is, in the location where the third portion of the lift gate 260 is positioned, both the vertical clearance and the horizontal clearance are concurrently controlled (e.g., as shown in FIG. 5D).

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention.

What is claimed is:

1. A pill feeder comprising:

a rotating disk for receiving a plurality of pills, the rotating disk configured to move the plurality of pills in a rotation direction about a surface of the rotating disk at a first angular velocity;

a rotating rim for receiving pills from the rotating disk through a receiving area, the rotating rim including a flat portion and a raised inner edge, the flat portion of the rotating rim configured to move pills received from the rotating disk in the rotation direction at a second angular velocity, an axis of rotation of the rotating rim different from an axis of rotation of the rotating disk, the raised inner edge configured to rotate at least a subset of pills that are misaligned with the rotation direction to align the subset of pills with the rotation direction of the rotating rim, wherein a cross-section of the raised inner edge has at least one acute angle;

a lift gate located on the rotating rim in the rotation direction of the rotating disk relative to the receiving area of the rotating rim, the lift gate configured to raise a height above the surface of the rotating rim that permits passage of a single layer of the plurality of pills, the lift gate comprising:

a first portion positioned before the separator gate, the first portion for pushing pills with a height larger than a threshold height to the rotating disk, and a second portion extending through the separator gate, the second portion for preventing pills from transferring from the rotating disk onto the rotating rim in a portion of the rotating disk where the width of pills is being controlled;

a separator gate located on the rotating disk in the rotation direction of the rotating rim relative to the receiving area of the rotating rim, the separator gate configured to open a width that permits passage of a single row of the plurality of pills; and an exit path located on the rotating rim in the rotation direction of the rotating disk relative to the separator gate and the lift gate, the exit path including at least a first portion having a first slope with respect to the flat portion of the rotating rim, and a second portion having a second slope greater than the first slope.

2. The pill feeder of claim 1, further comprising:

a first motor coupled to the rotating disk, the first motor for causing rotating disk to rotate at the first angular velocity; and a second motor coupled to the rotating rim, the second motor for causing the rotating rim to rotate at the second angular velocity.

3. The pill feeder of claim 1, wherein the second angular velocity is slower than the first angular velocity.

4. The pill feeder of claim 1, wherein at least a portion of the rotating disk is flush with at least a portion of the rotating rim.

5. The pill feeder of claim 1, wherein the rotating disk and the rotating rim rotate in a counterclockwise direction.

6. The pill feeder of claim 1, further comprising:

a bowl surrounding the rotating disk, the bowl configured to prevent radial movement of pills located near a edge of the rotating disk.

7. The pill feeder of claim 6, wherein the bowl is attached to the rotating rim, and wherein the bowl rotates in the rotation direction at the second angular velocity.

8. The pill feeder of claim 1, further comprising:

an exit path sensor located on the exit path, the exit path sensor configured to determine an exit rate of pills as the pills pass through the exit path.

9. The pill feeder of claim 8, wherein the first angular velocity and the second angular velocity is adjusted to control the exit rate of the pills as the pills pass through the exit path.

10. The pill feeder of claim 1, wherein the rotating disk comprises a plurality of ridges embedded on a surface of the rotating disk.

11. The pill feeder of claim 1, wherein the lift gate is further configured to push pills that are stacked on top of other pills towards the rotating disk.

12. The pill feeder of claim 1, wherein the separator gate is further configured to reduce a width of the rotating rim.

13. The pill feeder of claim 1, wherein the separator gate is further configured to push pills towards an inner edge of the rotating rim.

14. The pill feeder of claim 1, wherein a portion of the lift gate extends to the separator gate, such that the height and width of pills is concurrently controlled.

15. A pill feeder comprising:

a rotating disk for receiving a plurality of pills, the rotating disk configured to move the plurality of pills in a rotation direction about a surface of the rotating disk at a first angular velocity;

a rotating rim for receiving pills from the rotating disk through a receiving area, the rotating rim configured to move pills received from the rotating disk in the rotation direction at a second angular velocity, an axis of rotation of the rotating rim different from an axis of rotation of the rotating disk, the rotating rim including a flat portion and a raised inner edge;

a separator gate located on the rotating disk in the rotation direction of the rotating rim relative to the receiving area of the rotating rim, the separator gate configured to open a width that permits passage of a single row of the plurality of pills; and a lift gate located on the rotating rim in the rotation direction of the rotating disk relative to the receiving area of the rotating rim, the lift gate configured to raise a height above the surface of the rotating rim that permits passage of a single layer of the plurality of pills, the lift gate comprising:

a first portion positioned before the separator gate, the first portion for pushing pills with a height larger than a threshold height to the rotating disk, and a second portion extending through the separator gate, the second portion for preventing pills from transferring from the rotating disk onto the rotating rim in a portion of the rotating disk where the width of pills is being controlled.

16. The pill feeder of claim 15, wherein the raised inner edge configured to rotate at least a subset of pills of the plurality of pills to align the subset of pills with the rotation direction of the rotating rim.

17. The pill feeder of claim 15, wherein the flat portion of the rotating rim is configured to move pills received from the rotating disk in the rotation direction at a second angular velocity.

18. The pill feeder of claim 15, further comprising an exit path located on the rotating rim in the rotation direction of the rotating disk relative to the separator gate and the lift gate, the exit path including at least a first portion having a first slope with respect to the flat portion of the rotating rim, and a second portion having a second slope greater than the first slope.

19. The pill feeder of claim 15, wherein at least a portion of the rotating disk is flush with at least a portion of the rotating rim.

20. The pill feeder of claim 15, further comprising:

a first motor coupled to the rotating disk, the first motor for causing rotating disk to rotate at the first angular velocity; and a second motor coupled to the rotating rim, the second motor for causing the rotating rim to rotate at the second angular velocity.

* * * * *